US006859147B2

(12) United States Patent
Buscemi

(10) Patent No.: US 6,859,147 B2
(45) Date of Patent: Feb. 22, 2005

(54) SYSTEM TO WARN OF AN APPROACHING EMERGENCY VEHICLE

(76) Inventor: Salvatore Buscemi, 2617 E. State St., Rockford, IL (US) 61108

( * ) Notice: Subject to any disclaimer, the term of this patent is extended or adjusted under 35 U.S.C. 154(b) by 99 days.

(21) Appl. No.: 10/422,599

(22) Filed: Apr. 24, 2003

(65) Prior Publication Data

US 2003/0201906 A1 Oct. 30, 2003

Related U.S. Application Data

(60) Provisional application No. 60/375,159, filed on Apr. 24, 2002.

(51) Int. Cl.[7] ..... G08G 1/00

(52) U.S. Cl. ..... 340/902; 348/115; 362/494

(58) Field of Search ..... 340/901–904; 455/345, 227, 228; 348/115, 116, 118, 148, 149; 701/224, 301; 362/494

(56) References Cited

U.S. PATENT DOCUMENTS 5,495,243 A * 2/1996 McKenna ..... 340/902
6,404,351 B1 * 6/2002 Beinke ..... 340/902
6,700,504 B1 * 3/2004 Aslandogan et al. ..... 340/901
2002/0008635 A1 * 1/2002 Ewing et al. ..... 340/902
2003/0006888 A1 * 1/2003 Burchette et al. ..... 340/425.5

* cited by examiner

*Primary Examiner*—Jeffery Hofsass
*Assistant Examiner*—Jennifer A. Stone
(74) *Attorney, Agent, or Firm*—Keith Frantz

(57) ABSTRACT

A system to warn an automobile driver of an approaching emergency vehicle includes at least one sensor (18) located in the motor vehicle (12), the sensor being responsive to sense the alert-status signal from the emergency vehicle and to provide an output signal indicative thereof, a control block (20) responsive to the signal from the sensor and operative to provide an output signal indicative thereof, visual indicia (16) associated with the face of the rearview mirror (14) and receiving the output signal from the control block, and an audio alert (22) also responsive to the output signal from the control block. The visual indicia include four indicia markers located at approximately 90 degrees from one another on horizontal and vertical axes visible on the face of the mirror to provide the driver with visual directional notification of the presence and location of the emergency vehicle. The four indicia markers are normally either invisible or visually muted with respect to the face of the mirror, and are individually illuminatable responsive to the output signal from the control block. The four indicia markers establish top, bottom, left and right indicia responsive to output signals associated with the presence of an emergency vehicle located ahead, behind, to the left and to the right of the motor vehicle, respectively.

8 Claims, 3 Drawing Sheets

SYSTEM TO WARN OF AN APPROACHING EMERGENCY VEHICLE

CROSS-REFERENCES TO RELATED APPLICATIONS

This application corresponds to and claims priority filing date benefit of U.S. Provisional Patent Application Ser. No. 60/375,159 filed Apr. 24, 2002.

REFERENCE TO SEQUENCE LISTING, TABLE, OR COMPUTER PROGRAM LISTING APPENDIX

N/A.

STATEMENT REGARDING FEDERALLY SPONSORED RESEARCH OR DEVELOPMENT

N/A.

BACKGROUND OF THE INVENTION

1. Field of Invention

The present invention relates generally to automotive safety systems.

More particularly, the invention relates to a system for warning the driver of a motor vehicle of an approaching emergency vehicle.

2. Description of Related Art

Traditionally, flashing lights are relied on to notify other traffic in the immediate vicinity of the presence of an emergency vehicle in alert status, and sirens are relied on to warn the traffic ahead and to the side of an approaching emergency vehicle. This basic warning system has been used by emergency vehicles for many decades. However, this basic warning system has several drawbacks and disadvantages.

At times, the driver of a motor vehicle will not hear the warning sirens, and the sudden appearance of the emergency vehicle can be disorienting to the driver. This potential situation presents a danger to all vehicles in the vicinity, and has resulted in automobile accidents, including accidents involving the emergency vehicle itself. The potential to not hear an approaching emergency vehicle can occur relatively often, such as during the hot summer or cold winter when the vehicle windows are closed and the heater or air conditioner is on, particularly if the radio is also on with the windows closed. Moreover, in recent years, passenger automobiles have become increasing more sound proof with the windows closed. As a result of these improvements in isolating the interior of passenger cars from outside noise, the danger of not hearing the siren from an approaching emergency vehicle has increased.

At other times, the driver of a motor vehicle may hear the warning sirens, but not be able to immediately detect from which direction the emergency vehicle is approaching, or whether the emergency vehicle is approaching or traveling away from the driver's vehicle. This situation also presents the potential for danger as drivers in the vicinity are distracted, swerve to the side of the road, or slow down in an effort to locate the emergency vehicle and access the situation.

Thus, it is clear that there is a need for a device that addresses the above-identified concerns regarding conventional emergency warning systems. In particular, there is a need for a vehicle safety and warning system that is capable of notifying the driver of a motor vehicle of an approaching emergency vehicle, from which direction the emergency vehicle is approaching, and whether the emergency vehicle is actually approaching or is traveling away from the driver's vehicle.

BRIEF SUMMARY OF THE INVENTION

The general aim of the invention is to provide a new and improved safety system for warning the driver of a motor vehicle of an approaching emergency vehicle.

An important objective of the invention is to provide the driver of the motor vehicle with a visual indication of an approaching emergency vehicle.

Another important objective of the invention is to provide the driver of the motor vehicle with a visual indication of the direction from which the emergency vehicle is approaching.

Yet another important objective of the invention is to provide the driver of the motor vehicle with visual indication of whether the emergency vehicle is actually approaching or is traveling away from the driver's vehicle.

A detailed objective is to achieve the foregoing by providing the driver with a visual indicia notification warning system in the inside, rearview mirror of the motor vehicle.

Still another objective of the invention is to optionally provide the driver of a motor vehicle with an audio warning in concert with the visual warning indication of an approaching emergency vehicle.

These and other objectives and advantages of the invention will become more apparent from the following detailed description when taken in conjunction with the accompanying drawings.

Briefly, a system in accordance with the invention provides the driver of a motor vehicle having an inside rearview mirror with a warning as to the presence and location of an emergency vehicle of the type generating an alert-status signal. The system includes (i) at least one sensor located in the motor vehicle, the sensor being responsive to sense the presence, location and strength of the alert-status signal from the emergency vehicle and to provide an output signal indicative thereof, (ii) a control block receiving the signal from the sensor and responsive thereto to supply an output signal indicative of the presence, location and strength of the alert-status signal, and (iii) visual indicia associated with the face of the rearview mirror and receiving the output signal from the control block. The visual indicia includes four indicia markers located at approximately 90 degrees from one another on horizontal and vertical axes visible on the face of the mirror that are responsive to the output signal from the control block to provide the driver with visual directional notification of the presence and location of the emergency vehicle. The four indicia markers are normally either invisible or visually muted with respect to the face of the mirror, and are individually illuminatable responsive to the output signal from the control block. The four indicia markers establish top, bottom, left and right indicia responsive to output signals associated with the presence of an emergency vehicle located ahead, behind, to the left and to the right of the motor vehicle, respectively. The preferred system also includes an audio alert responsive to the output signal from the control block.

In preferred embodiments, the four indicia markers are located proximate the top, bottom, left and right sides, respectively, of the mirror. In certain preferred embodiments, the four indicia markers also include labels associated with either the words AHEAD, BEHIND, LEFT and RIGHT, or the words Front, Rear, Driver and Passenger, or beginning letters thereof, to further establish a directional relationship between the emergency vehicle and the motor vehicle.

In one embodiment, the visual indicia is provided in the form of illuminatable indicia encircling 360 degrees around the face of the mirror, with the encircling indicia establishing at least the four indicia markers. In this instance, the encircling indicia is responsive to the output signal from the control block to indicate location of the emergency vehicle around 360 degrees with respect to the motor vehicle.

In preferred embodiments, the warning system of the present invention includes visual indicia that is further responsive to the output signal from the control block to provide notification as to whether the emergency vehicle is approaching the motor vehicle or is traveling away from the motor vehicle. In this instance, the visual indicia is provided responsive in two alternate visual modes such as, for example, continuously illuminated for an approaching emergency vehicle, and blinking for an emergency vehicle traveling away from the motor vehicle. This visual indicia embodiment is optionally operative to provide a strength of illuminated indicia is a function of the distance between the emergency vehicle and the motor vehicle.

Figure 1:
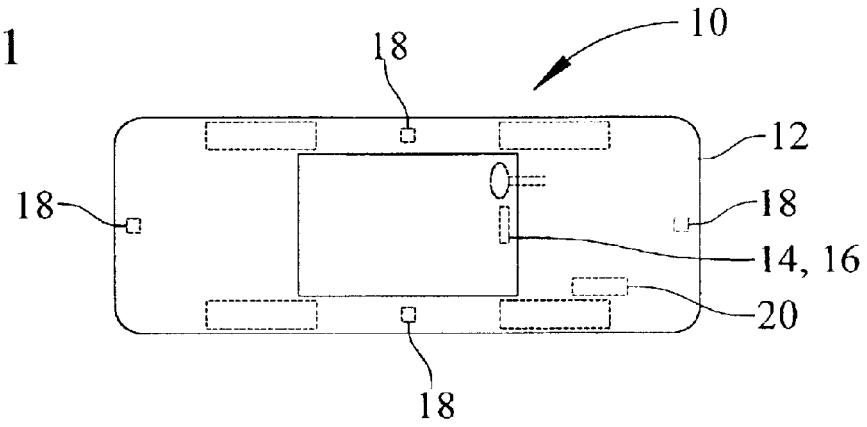
FIG. 1 is a top plan view of an automobile equipped with an emergency vehicle warning system in accordance with the present invention.

Reference numerals shown in the drawings correspond to the following:

10—warning system
12—motor vehicle
14—rearview mirror
14A—alternate rearview mirror
16—warning and directional indicia
18—sensors
20—control block
20A—alternate control block
22—auditory alert
24—alternate warning system
26—alternate sensor
28—alternate directional warning indicia
30—second alternate warning system
32—second alternate sensors
34—second alternate control block
36—second alternate rearview mirror
38—second alternate directional warning indicia
40—360-degree directional indicia display While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings in FIGS. 1–4 as warning system 10 for use in a motor vehicle 12. The warning system 10 is capable of providing the driver of the motor vehicle 12 with a visual notification warning of an approaching emergency vehicle (not shown), and visual indication of from which direction the emergency vehicle is approaching. As used herein, it will be understood that the phrase "emergency vehicle" includes ambulance, police, fire, and other vehicles provided with an alert-status signal generator intended to warn drivers of the presence or approach of such vehicle.

Figure 2:
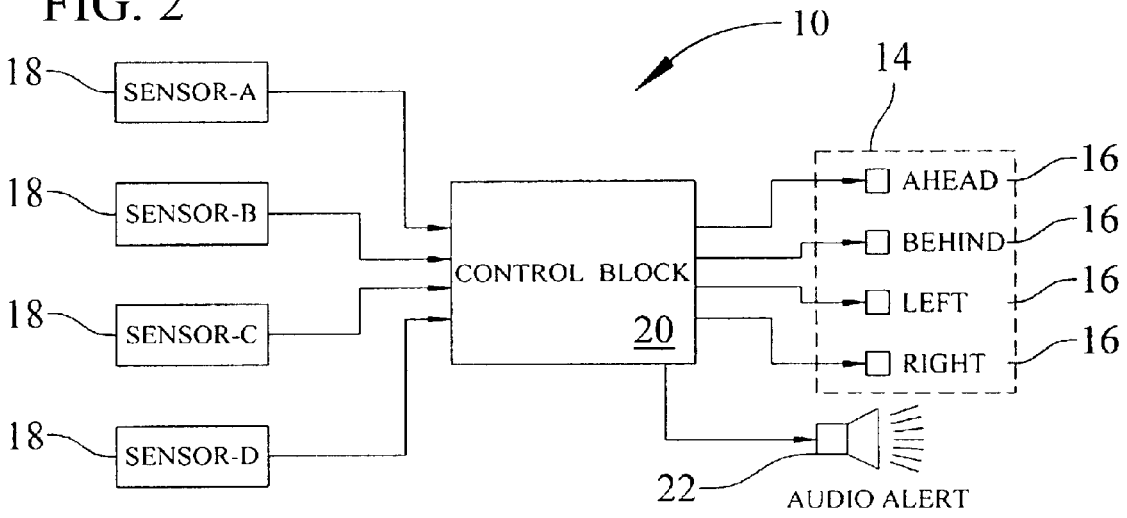
FIG. 2 is a schematic diagram of the emergency vehicle warning system in accordance with the invention.

As shown in FIG. 2, the warning system 10 includes an inside rearview mirror 14 provided with emergency vehicle visual warning and directional indicative indicia 16, sensors 18 that detect the presence and approach of an emergency vehicle and provide output signals indicative thereof, and a logic control block 20 operably connected between the sensors and the visual warning and directional indicia of the mirror; the logic control block receiving the signals from the sensors and operative to provide one or more output signals to illuminate or otherwise drive the visual warning and directional indicia.

Figure 6:
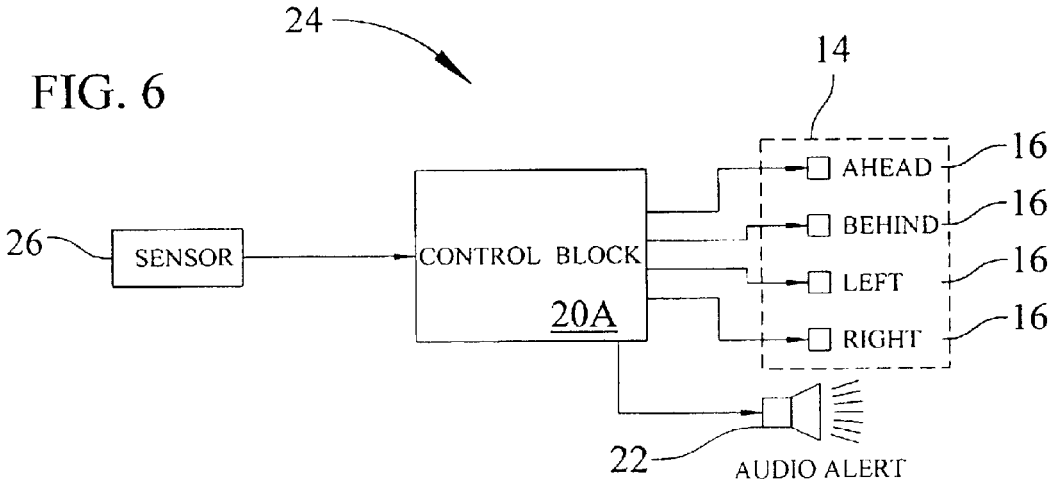
FIG. 6 is a schematic diagram of an alternate embodiment warning system in accordance with the invention.

In general, the sensors 18 are of a type suitable to detect the presence of an approaching emergency vehicle from any direction, and are positioned at suitable locations in the motor vehicle 12 therefore. All emergency vehicles of the subject type are equipped with an alert-status signal generator. Traditionally, the alert signal from an emergency vehicle includes audible sirens. More recently, the alert signal may also include a radio or other frequency signal such as is used to control traffic stop lights as the emergency vehicle approaches. Detection of an emergency vehicle is accomplished by the sensors directionally detecting the alert signal such as the high-frequency siren, the radio frequency signal, or other signal associated with the emergency vehicle. The number, type and position of the sensors will vary depending on specific embodiments, alert signal type, and desired system characteristics. In the embodiment shown in FIG. 1, four semi-directional sensors 18 are positioned near the front, back, left and right sides of the motor vehicle 12 for detecting an emergency vehicle approaching from ahead of the motor vehicle, from behind the motor vehicle, from the left of the motor vehicle, and from the right of the motor vehicle, respectively. Alternately, for example, as shown in FIG. 6, system 24 includes a single multi-directional single sensor 26 capable of sensing an approaching emergency vehicle from 360 degrees is appropriately positioned in the motor vehicle, and is associated with alternate control block 20A in accordance herewith.

Figure 3:
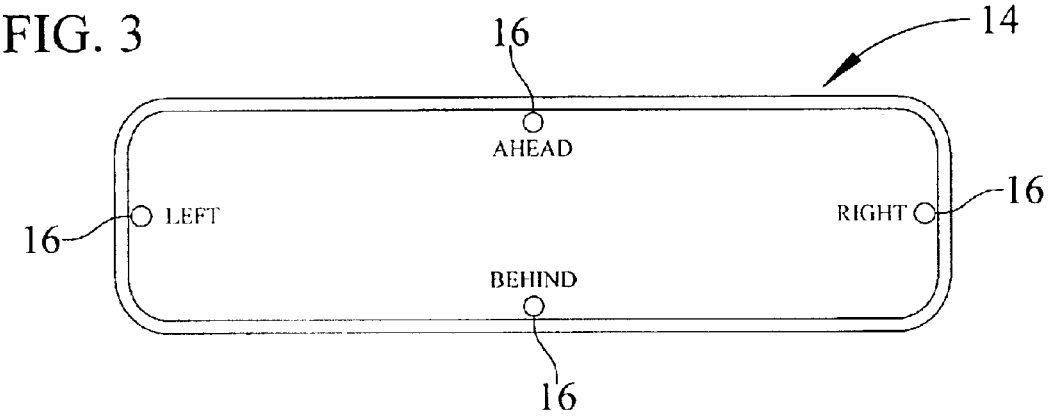
FIG. 3 is a front view of a rearview mirror incorporating certain unique aspects of the invention, and showing visual warning and directional indicia in accordance with the invention in a visually distinct alert-status condition.
Figure 4:
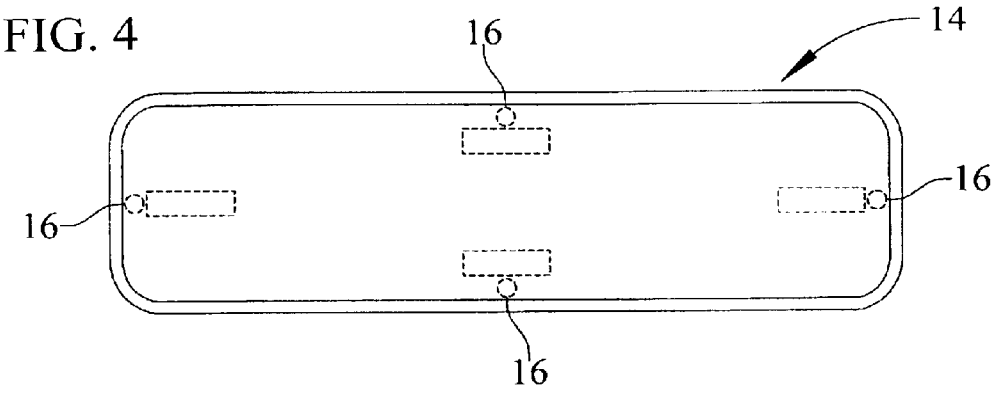
FIG. 4 is a view similar to FIG. 3 and showing the visual warning and directional indicia in accordance with in a visually muted normal condition.

In accordance with the invention, the mirror 14, as shown in FIGS. 3 and 4, is provided with a set of visual warning and directional indicia 16 for indicating AHEAD, BEHIND, LEFT and RIGHT directions with respect to the position of the driver and the motor vehicle. The visual directional indicia are positioned in association with the top, bottom, left and rights sides of the mirror to provide indicia associated with the AHEAD, BEHIND, LEFT and RIGHT directions, respectively, and in the embodiment shown, are provided in the form of circular symbolic presentations and associated labels. Alternate visual notification directional indicia may be provided, such as with only labels or symbolic presentations in the four positions, 90 degrees apart, and corresponding to the opposite locations on horizontal and vertical axes in the face of the mirror.

Figure 5:
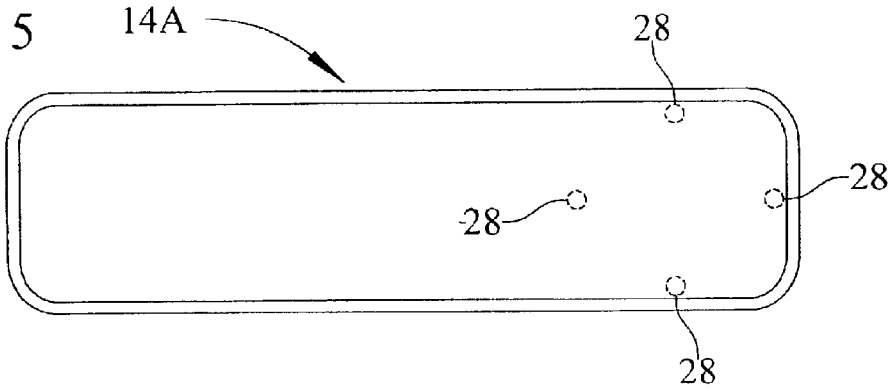
FIG. 5 is a view similar to FIG. 3 of an alternate embodiment mirror and visual warning and directional indicia in a visually muted normal condition.

The directional indicia 16 are preferably of a type that are generally invisible, or at least visually muted during the time when the warning system is inactive, when no emergency vehicle is detected, and that become illuminated or otherwise visibly distinct upon detection of an emergency vehicle. This is represented in the drawings in which the directional indicia is shown visually muted or invisible as represented by the dashed lines in FIG. 4, and distinctly visible with solid lines in FIG. 3. During the time when no emergency vehicle is detected, the mirror will appear as a normal mirror with invisible indicia, or with visually muted representation shown in FIG. 4. Upon detection by the system 10 of an emergency vehicle, the appropriate visual warning and directional indicia 16 will become illuminated or otherwise distinctly visible as shown in FIG. 3. It is noted that all four visual warning indicia are shown visually distinct in FIG. 3, however, during operation of the system, only one, or at most two of the indicia will be illuminated at any one time. Specifically, the indicia 16 are selectively illuminated when an alert-status signal is detected to indicate the presence of an approaching emergency vehicle. For example, the top AHEAD warning indicia is illuminated upon detection of an approaching emergency vehicle from ahead of the motor vehicle 12. Similarly, the LEFT, RIGHT and BEHIND warning indicia are selectively illuminated upon detection of an approaching emergency vehicle from those respective directions in relation to the vehicle 12. Alternate directional indicia arrangements may also be provided such as the alternate arrangement is shown in FIG. 5 in which the directional indicia 28 is associated with the right hand side of the mirror.

In keeping with the invention, the logic control block 20 includes an electrical/electronic circuit and/or digital processor technology that receives and process the signals from the sensors 18, and provides signals to illuminate or otherwise drive the warning and directional indicia 16 of the mirror 14. In the embodiment shown in FIG. 2, the logic control block 20 receives four input signals, one from each of four sensors, and provides four output signals associated with the four basic directions from which the emergency vehicle may be approaching. In this instance, the control block 20 is preferably adapted to provide either one output signal at a time to drive the desired directional indicia 16, or two quadrant-adjacent output signals to simultaneously drive two adjacent directional indicia. If, for example, the emergency vehicle is approaching from behind, the output signal is provided to the BEHIND indicia of the mirror. Alternately, for example, if the emergency vehicle is approaching approximately equally from behind and on the left side, the output signal is provided to illuminate both the BEHIND and LEFT indicia.

The warning system 10 further includes an auditory alert 22 in addition to the visual warning indicia notification provided at the mirror. The auditory alert is provided in any suitable form, such as a beeper, a buzzer or a speaker, or connected to the stereo speakers of the motor vehicle. An additional output signal provided from the logic control block 20 drives the auditory alert in concert with the visual directional warning indicia, and may include, for example, pre-recorded message signals with further directional indicia stored in and transmitted from the control block. This auditory alert provides the driver of the vehicle with an advance "heads-up" to check the mirror for the location of a detected emergency vehicle.

With the above-described arrangement, the warning system 10 is operative to provide the driver with warning and directional indicia of an approaching emergency vehicle. As will be evident, the warning system 10 is also operative to provide the driver of the motor vehicle with directional indication of the presence of an emergency vehicle that is not moving, but which is transmitting its alert signal such as in preparation thereof.

In certain embodiments, the sensors 18 and logic control block 20 are operative to sense and provide visual indication of the presence of an emergency vehicle that is traveling in a direction away from the driver and motor vehicle 12. In this instance, the sensors provide the logic control block with signals indicative of the distance, or change of distance, between the emergency vehicle in relation to the motor vehicle. The control block then processes these distance-indicative signals, determines whether the emergency vehicle is approaching or traveling away from the motor vehicle, and drives the visual warning and directional indicative indicia 16 in one of two pre-programmed operating modes, one mode for an approaching emergency vehicle and the other mode for an emergency vehicle traveling away from the motor vehicle. This embodiment preferably also include logic determination and processing for a third mode during which the emergency vehicle is traveling substantially parallel to the motor vehicle. The illumination modes for this embodiment will take a visually convenient form such as blinking warning indicia 16 for an emergency vehicle traveling away from the motor vehicle, and solid illumination warning indicia 16 for an approaching emergency vehicle. In this instance, the brightness of the illumination optionally increases as the emergency vehicle becomes closer to the motor vehicle, and the brightness of the flashing indicia as the distance from the motor vehicle increases. Alternately, for example, the warning indicia are illuminated with one color for an emergency vehicle traveling away from the motor vehicle, and illuminated with a second color for an approaching emergency vehicle.

Figure 7:
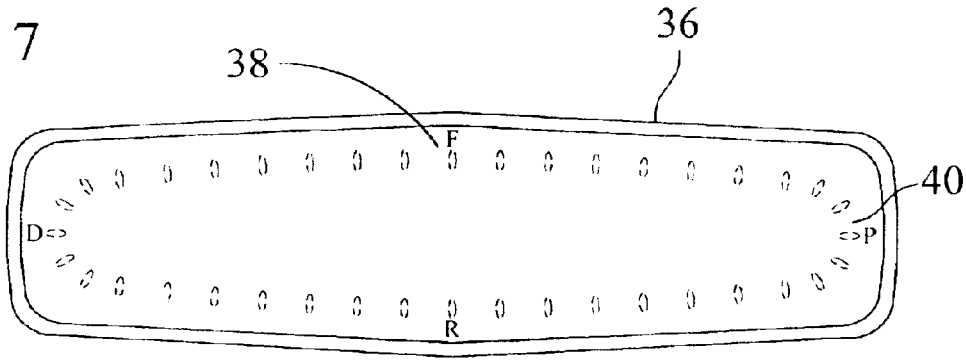
FIG. 7 is a view similar to FIG. 3 of a second alternate embodiment mirror and visual warning and directional indicia in a visually muted normal condition.
Figure 8:
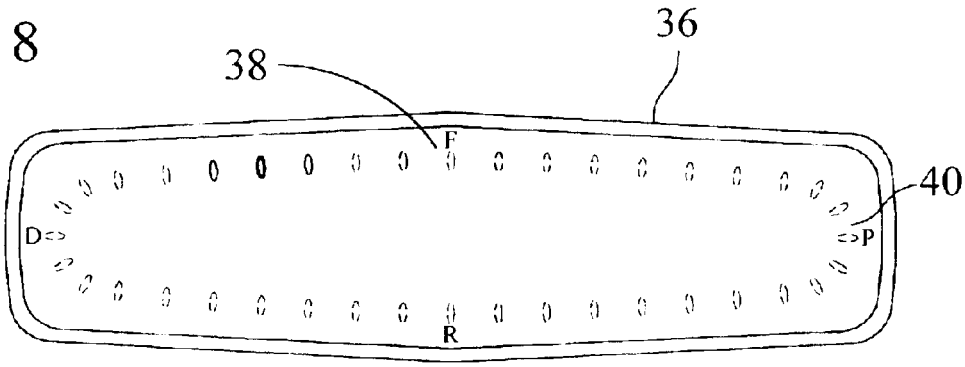
FIG. 8 is a view of the embodiment of FIG. 7 with the warning and directional indicia in its visually distinct alert-status condition.
Figure 9:
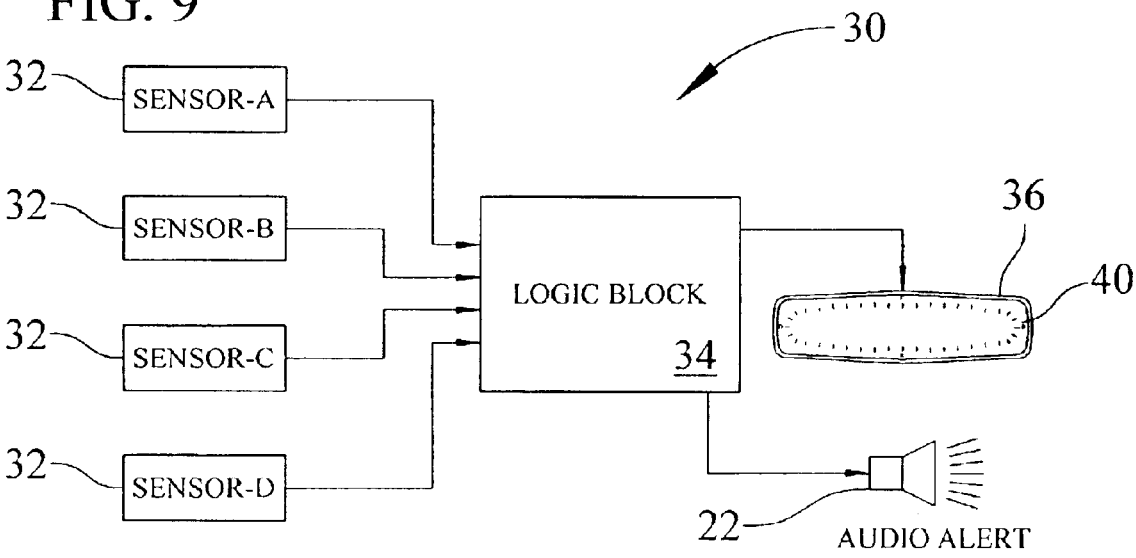
FIG. 9 is a schematic diagram of a second alternate embodiment warning system in accordance with the invention and incorporating the mirror embodiment shown in FIGS. 7–8.

For purposes of further illustration, an alternate embodiment warning system 30 is shown in FIGS. 7–9. In this instance, the sensors 32 and control block 34 are cooperative to provide an output signal that is directionally indicative of an emergency vehicle location with respect to 360 degrees around the motor vehicle and the distance therefrom, and the mirror 36 is provided with directional warning indicia 38 including selectively visibly distinct letters F, R, D and P associated with the front, rear, driver side, and passenger side, respectively, and a generally encircling visually-analog or digitally spaced display 40 adapted to simulate directional indicia encircling 360 degrees around the motor vehicle. In the embodiment shown, the 360-degree directional indicia display 40 is provided in the form of spaced illuminatable LEDs responsive to the directional-distance indicate signal from the control block. In particular, as shown in FIG. 7, the directional indicia display is normally invisible or visually muted, and as shown in FIG. 8, LEDs corresponding to the general direction from which the emergency vehicle is approaching are illuminated, with the center illuminated LED visually distinct from the surrounding LEDs such as shining brighter or as a different color to provide the driver with distance indicia. This embodiment may also include provision for operation as described above to indicate whether the emergency vehicle is approaching the motor vehicle or traveling away from the motor vehicle such as with either solid or flashing illuminated LED(s). Those skilled in the art will readily devise and construct additional alternate embodiments in accordance with the invention.

From the foregoing, it will be apparent that the present invention brings to the art a new and improved warning and alert system which is uniquely adapted to provide the driver of a motor vehicle with a warning and directional indicia for the presence and approach of an emergency vehicle. In particular, the warning system in accordance with the invention is capable of notifying the driver of a motor vehicle of an approaching emergency vehicle, from which direction the emergency vehicle is approaching, and whether the emergency vehicle is actually approaching or is traveling away from the driver's vehicle.

I claim:

1. A system to provide the driver of a motor vehicle having an inside rearview mirror with a warning of the presence and location of an emergency vehicle of the type generating an alert-status signal, the system comprising a) a sensor located in the motor vehicle, the sensor being responsive to sense the presence, location and strength of the alert-status signal from the emergency vehicle and to provide an output signal indicative thereof, b) a control block receiving the signal from the sensor and responsive thereto to supply an output signal indicative of the presence, location and strength of the alert-status signal, and c) visual indicia associated with the face of the rearview mirror and receiving the output signal from the control block, the visual indicia being responsive to said output signal to provide the driver with visual directional notification of the presence and location of the emergency vehicle,—the visual indicia including four indicia markers located at approximately 90 degrees from one another on horizontal and vertical axes visible on the face of the mirror,—the four indicia markers being normally one of invisible and visually muted with respect to the face of the mirror and being individually illuminatable responsive to the output signal from the control block,—the four indicia markers establishing top, bottom, left and right indicia responsive to output signals associated with the presence of an emergency vehicle located ahead, behind, to the left and to the right of the motor vehicle, respectively.

2. The warning system as defined in claim 1 further comprising an audio alert responsive to the output signal from the control block.

3. The warning system as defined in claim 1 in which the four indicia markers are located proximate the top, bottom, left and right sides, respectively, of the mirror.

4. The warning system as defined in claim 1 in which the visual indicia includes illuminatable indicia encircling 360 degrees around the face of the mirror, said encircling indicia including said four indicia markers, said encircling indicia being further responsive to the output signal from the control block to indicate location of the emergency vehicle around 360 degrees with respect to the motor vehicle.

5. The warning system as defined in claim 1 in which the visual indicia is further responsive to the output signal from the control block to provide notification as to the emergency vehicle one of approaching the motor vehicle and traveling away from the motor vehicle.

6. The warning system as defined in claim 5 in which the visual indicia are responsive as continuously illuminated for an approaching emergency vehicle and as blinking for an emergency vehicle traveling away from the motor vehicle.

7. The warning system as defined in claim 6 in which the strength of the illuminated visual indicia is a function of the distance between the emergency vehicle and the motor vehicle.

8. The warning system as defined in claim 1 in which the four indicia markers include labels associated with one of (i) AHEAD, BEHIND, LEFT and RIGHT and (ii) Front, Rear, Driver and Passenger, directional relations between the emergency vehicle and the motor vehicle.

* * * * *